US010519583B2

(12) United States Patent
Moon

(10) Patent No.: US 10,519,583 B2
(45) Date of Patent: Dec. 31, 2019

(54) METHOD OF WEAVING CAMOUFLAGE FABRIC OF THREE-PLY JACQUARD TEXTURE USING JACQUARD LOOM

(71) Applicant: Jae Hyuk Moon, Daegu (KR)

(72) Inventor: Jae Hyuk Moon, Daegu (KR)

(73) Assignee: DONG-A TOL CO., LTD., Daegu (KR)

( * ) Notice: Subject to any disclaimer, the term of this patent is extended or adjusted under 35 U.S.C. 154(b) by 71 days.

(21) Appl. No.: 15/974,638

(22) Filed: May 8, 2018

(65) Prior Publication Data

US 2019/0040562 A1 Feb. 7, 2019

(30) Foreign Application Priority Data

Aug. 2, 2017 (KR) ..... 10-2017-0098195

(51) Int. Cl.

| | |
|---|---|
| ***D03D 15/00*** | (2006.01) |
| ***D03D 1/00*** | (2006.01) |
| ***D06C 23/00*** | (2006.01) |
| ***D03D 11/00*** | (2006.01) |
| ***D03D 13/00*** | (2006.01) |
| ***D03C 3/00*** | (2006.01) |

(52) U.S. Cl.

CPC ..... *D06C 23/00* (2013.01); *D03C 3/00* (2013.01); *D03D 1/0047* (2013.01); *D03D 11/00* (2013.01); *D03D 13/004* (2013.01); *D03D 15/0033* (2013.01); *D06C 2700/31* (2013.01); *D10B 2507/00* (2013.01)

(58) Field of Classification Search

CPC ..... F41H 3/02; F41H 3/00; Y10S 428/919; D06P 1/004; D06P 1/0012; D06P 1/0096; D06P 1/00; B32B 2459/00; D03D 15/00; D03D 1/0047; D03D 13/004; D03D 2700/0137

See application file for complete search history.

(56) References Cited

U.S. PATENT DOCUMENTS 4,034,375 A * 7/1977 Wallin ..... H01Q 17/002 342/3
4,064,305 A * 12/1977 Wallin ..... D04B 1/14 442/308
4,557,965 A * 12/1985 Karlsson ..... H01Q 17/005 428/196
4,645,704 A * 2/1987 Hellwig ..... D06Q 1/04 427/270
4,659,602 A * 4/1987 Birch ..... F41H 3/00 428/88

(Continued)

*Primary Examiner* — Robert H Muromoto, Jr.

(74) *Attorney, Agent, or Firm* — John K. Park; Park Law Firm

(57) ABSTRACT

Disclosed is a camouflage fabric which simplifies a preparation process of warps and wefts so as to assure convenience in warp and weft preparation and acquires combinations of various patterns and colors using a three-ply fabric structure so as to satisfy aesthetics, i.e., one of functions of clothing, and to have an excellent camouflaging effect. Dyed yarns of a dark color and dyed yarns of a light color are alternately arranged as the warps, dyed yarns of three colors differing from the colors of the warps are used as the wefts, the warps and the wefts are woven into the camouflage fabric of a three-ply jacquard texture using a jacquard loom and, thus, the camouflage fabric may have combinations of various patterns and colors.

4 Claims, 8 Drawing Sheets

(56) References Cited

U.S. PATENT DOCUMENTS 4,671,988 A * 6/1987 Dowell ..... F41H 3/00 2/900
4,767,649 A * 8/1988 Birch ..... F41H 3/00 428/132
5,077,556 A * 12/1991 Aisslinger ..... H01Q 17/005 342/3
5,312,678 A * 5/1994 McCullough, Jr. ..... B32B 5/22 442/189
5,348,789 A * 9/1994 Hellwig ..... F41H 3/02 428/131
5,532,052 A * 7/1996 Eng ..... F41H 3/02 428/919
6,605,340 B1 * 8/2003 Heiniger ..... F41H 3/00 428/15
6,787,212 B2 * 9/2004 Strength ..... B32B 3/26 428/102
6,806,480 B2 * 10/2004 Reshef ..... G09F 3/00 250/495.1
6,859,983 B2 * 3/2005 Curtis ..... B32B 5/02 28/104
7,229,680 B1 * 6/2007 Crompton ..... B32B 38/06 428/88
7,968,165 B2 * 6/2011 Barnes ..... A47G 27/0275 428/48
8,013,776 B2 * 9/2011 Child ..... H01Q 17/005 342/1
8,236,714 B2 * 8/2012 Frankel ..... F41H 3/02 2/69
9,920,464 B2 * 3/2018 Moon ..... D03D 13/004
10,024,841 B2 * 7/2018 Meinert ..... G01N 3/08
10,156,427 B2 * 12/2018 Litwin ..... F41H 3/02
10,203,183 B2 * 2/2019 Morag ..... F41H 3/02
10,330,442 B2 * 6/2019 Castille ..... F41H 3/02
2003/0044575 A1 * 3/2003 Hexels ..... F41H 3/02 428/131
2003/0092341 A1 * 5/2003 Curtis ..... B32B 5/02 442/327
2004/0157038 A1 * 8/2004 Strength ..... B32B 3/26 428/102
2006/0127570 A1 * 6/2006 Casburn ..... B41M 3/00 427/145
2006/0233996 A1 * 10/2006 Oakey ..... A47G 27/0275 428/44
2007/0009679 A1 * 1/2007 Holcombe ..... F41H 3/02 428/17
2009/0049579 A1 * 2/2009 Roberts ..... D04B 1/126 2/81
2009/0214852 A1 * 8/2009 Kelsey ..... B32B 5/02 428/315.9
2010/0040844 A1 * 2/2010 Larson ..... E04F 13/08 428/203
2010/0093238 A1 * 4/2010 Schwarz ..... F41H 3/02 442/116
2010/0285285 A1 * 11/2010 Winterhalter ..... D02G 3/047 428/196
2011/0095931 A1 * 4/2011 Child ..... F41H 3/02 342/3
2013/0335809 A1 * 12/2013 Shields ..... B44F 1/10 359/296
2014/0154482 A1 * 6/2014 Jang ..... F41H 3/00 428/196
2015/0000088 A1 * 1/2015 King ..... A44B 18/0003 24/451
2016/0032182 A1 * 2/2016 Agrawal ..... C09K 11/025 442/59
2017/0362758 A1 * 12/2017 Moon ..... D03D 13/004
2018/0066921 A1 * 3/2018 Wagner ..... B32B 3/266
2019/0017785 A1 * 1/2019 Morag ..... B32B 38/145
2019/0112733 A1 * 4/2019 Abouraddy ..... D01F 6/54

* cited by examiner

METHOD OF WEAVING CAMOUFLAGE FABRIC OF THREE-PLY JACQUARD TEXTURE USING JACQUARD LOOM

BACKGROUND OF THE INVENTION

Field of the Invention

The present invention relates to a method of weaving a camouflage fabric using a jacquard loom, and more particularly to provide a camouflage fabric woven from dyed yarns used as warps and wefts, which may have different color arrangements of the warps and the wefts and express a camouflage pattern through combinations of various patterns and colors so as to exert excellent functionality of clothing and camouflaging effect.

Description of the Related Art

In general, fabrics for military uniforms which satisfy both functions of clothing and a camouflaging function may be regarded as the best fabrics for military uniforms.

In order to satisfy these functions, various countries around the world have developed and applied fabrics for military uniforms of camouflage patterns which are suitable for their own geographies and, recently, we have also applied digital combat uniforms which are printed with a pattern disguised as Korean geography instead of a previous Korean camouflage pattern.

Further, military uniforms corresponding to functional clothing distinguish soldiers from other groups and have a symbolic function of making soldiers feel a sense of belonging to an army group. Thus, military uniforms may be regarded as clothing having a combination of a large number of functions in terms of clothing.

Recently, in order to satisfy such multifunctionality, a fabric woven with a rip stop texture expressed in a checkerboard pattern is acquired and is then printed through a digital printing method, thus expressing a designated pattern.

A military uniform, made of a rip stop fabric printed through such a digital printing method, has a low three-dimensional effect and a poor texture due to the even surface of the fabric, and is limited in color expression and thus has a decreased camouflaging effect because the fabric is printed using only a set number of colors for printing.

Further, post-treatments, such as printing of the woven fabric, steaming of the fabric to fix dyes to the fabric and washing of the fabric after steaming, require significant time and cost.

As related art documents in relation to weaving of camouflage fabrics, Korean Patent Publication No. 10-1996-0000874 entitled "Narrow Band Laser Apparatus" (Patent Document 1), Korean Patent Publication No. 10-1989-0002178 entitled "Method for Manufacturing Camouflage Cloth against Infrared Detection" (Patent Document 2) and Korean Patent Publication No. 10-1989-0002179 entitled "Method for Manufacturing Camouflage Cloth with Complex Color Pattern Printing against Visual and Infrared Detection" (Patent Document 3) are proposed.

However, the methods disclosed in the above-described Patent Documents, in which a woven fabric is printed using dyes of composite colors, are insufficient to exert an excellent three-dimensional effect, a good texture and a high camouflaging effect.

In order to solve such drawbacks, the present inventor(s) filed Korean Patent No. 10-1677929 entitled "Camouflaging Fabrics by Jacquard Loom and Its Weaving Method" (Patent Document 4).

In Patent Document 4, yarns are dyed first, and the dyed yarns are woven as warps and wefts into a fabric using a jacquard loom so as to simultaneously express a delicate sense of colors of a check type by arranging the warps and wefts by gradation and a three-dimensional camouflage pattern with a jacquard texture, and thus the fabric may satisfy functions of clothing, such as aesthetics, and a camouflaging effect serving as an important function of a military uniform and be used as the best fabric for military uniforms having economic efficiency.

However, the method of Patent Document 4 is disadvantageous in that it takes a long time to sequentially arrange the warps and the wefts by gradation during a preparation process of the warps and the wefts.

RELATED ART DOCUMENT

Patent Document (PATENT DOCUMENT 1) Korean Patent Publication No. 10-1996-0000874 entitled "Narrow Band Laser Apparatus"

(PATENT DOCUMENT 1) Korean Patent Publication No. 10-1989-0002178 entitled "Method for Manufacturing Camouflage Cloth against Infrared Detection"

(PATENT DOCUMENT 3) Korean Patent Publication No. 10-1989-0002179 entitled "Method for Manufacturing Camouflage Cloth with Complex Color Pattern Printing against Visual and Infrared Detection"

(PATENT DOCUMENT 4) Korean Patent No. 10-1677929 entitled "Camouflaging Fabrics by Jacquard Loom and Its Weaving Method"

SUMMARY OF THE INVENTION

Therefore, the present invention has been made in view of the above problems, and it is an object of the present invention to provide a camouflage fabric which simplifies a preparation process of warps and wefts so as to assure convenience in warp and weft preparation and acquires combinations of various patterns and colors using a three-ply fabric structure so as to satisfy aesthetics, i.e., one of functions of clothing, and to have an excellent camouflaging effect.

In accordance with the present invention, the above and other objects can be accomplished by the provision of a method of weaving a camouflage fabric in which dyed yarns of a dark color and dyed yarns of a light color are alternately arranged as warps, dyed yarns of three colors differing from the colors of the warps are used as wefts, and the warps and the wefts are woven into the camouflage fabric of a three-ply jacquard texture using a jacquard loom so that the camouflage fabric has combinations of various patterns and colors.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
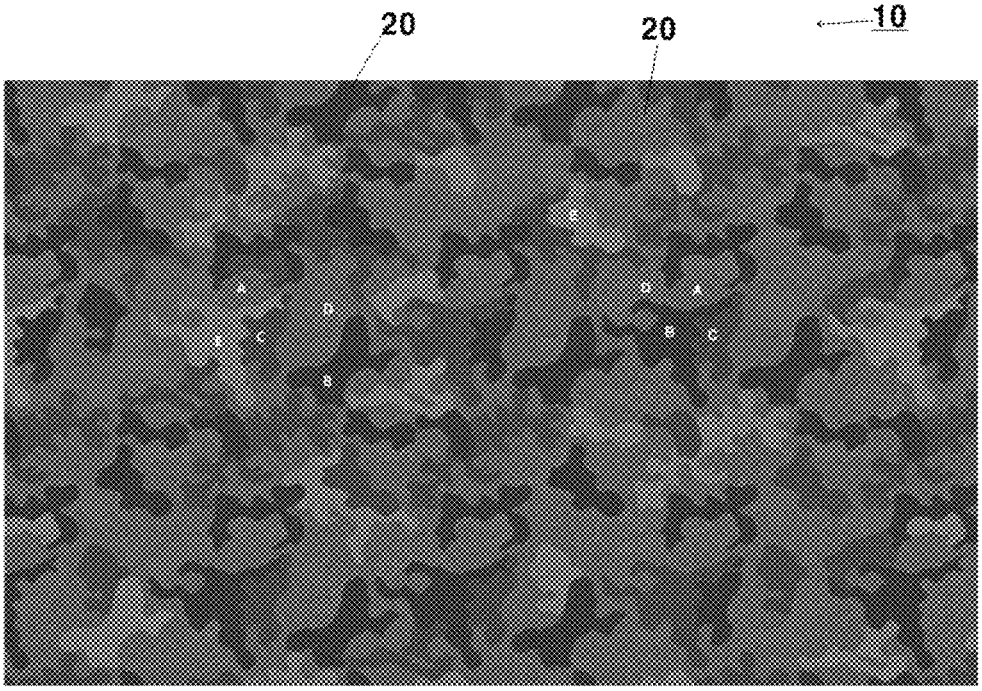
FIG. 1 is a view exemplarily illustrating a camouflage fabric woven in accordance with the present invention.

Reference will now be made in detail to the preferred embodiments of the present invention, examples of which are illustrated in the accompanying drawings. Wherever possible, the same reference numbers will be used throughout the drawings to refer to the same or like parts.

Hereinafter, weaving of a camouflage fabric in accordance with the present invention will be described in detail.

The present invention provides a method of manufacturing a camouflage fabric 10 which is woven from dyed yarns as warps and wefts using a jacquard loom so as to have a jacquard texture through combinations of desired patterns and colors.

Most jacquard looms which are recently used now are electronic jacquard looms, and an electronic jacquard loom weaves a fabric by selecting dyed yarns of various colors satisfying shapes and colors of patterns expressed in a camouflage fabric as warps and wefts, making a weaving design and a structural textile design to be used, programming them into a file, and inputting the programmed file into a controller of the electronic jacquard loom.

Here, sizes and colors of patterns 20 of the camouflage fabric are selected so as to be suitable for camouflage in consideration of characteristics of geography.

Particularly, the present invention provides the camouflage fabric 10 of a jacquard texture woven using a jacquard loom, which has an excellent camouflaging effect and improves tactility and aesthetics, which a printed camouflage fabric may not provide, while satisfying an aesthetic sense of camouflage fabrics of a spotted pattern or a digital pattern, which are widely used now in various countries in the world, using characteristics of the jacquard fabric.

Particularly, the camouflage fabric 10 in accordance with the present invention may minimize the number of colors of dyed yarns used as warps and wefts and be formed through combinations of various shapes and colors of the patterns 20 using a jacquard texture.

As warps, dyed yarns of two colors, i.e., a color A and a color B, are arranged. Here, the necessary number of strands of the warps is uniformly arranged (warping) and wound on a warp beam (beaming), the warps wound on the warp beam are inserted into healds and a reed of the jacquard loom according to a weaving design, i.e., a structural textile design, (drawing-in), and the warp beam is installed at the jacquard loom (looming), and thereby the warps are prepared.

At this time, two colors having brightnesses which are clearly distinguishable from each other, i.e., having a large brightness difference, may be used as the colors of the warps, i.e., the color A and the color B.

For example, warps of a dark color and a light color, such as dark navy and beige, may be alternately arranged.

Further, although the warps used in the present invention are not limited to a specific material, T/C or T/R blended yarns are mainly used as the warps.

As wefts, dyed yarns of three colors differing from the colors of the warps, i.e., a color C, a color D and a color E, are repeatedly arranged. Here, although the wefts are not limited to a specific material, T/C or T/R blended yarns are mainly used as the wefts.

When preparation of the warps and the wefts according to the weaving design is completed, as described above, the jacquard loom is operated to weave the camouflage fabric 10. Here, the warps of the color A and the warps of the color B having a large brightness difference are raised and lowered to form a shedding portion, the wefts of the color C, the wefts of the color D and the wefts of the color E are sequentially inserted into the shedding portion of the warps and, thus, the camouflage fabric 10 is woven by interlacing the warps with the wefts according to the structural textile design and shapes and colors of the patterns 20 are varied according to structural forms of the warps and the wefts during the above weaving process.

In the present invention, warps of two or more colors and wefts of three or more colors may be used and, in this case, the patterns 20 of the woven camouflage fabric 10 may be expressed in a wider variety of colors.

A method of weaving a camouflage fabric in accordance with one embodiment of the present invention will be described in detail with reference to the accompanying drawings.

The present invention provides a method of weaving a camouflage fabric 10 using an electronic jacquard loom, including determining shapes and colors of patterns 20 of the camouflage fabric 10 desired to be woven, determining colors of warps and wefts expressing the colors of the patterns 20, making a weaving design and a structural textile design to express the shapes and colors of the patterns 20 using the warps and the wefts, programming them into a file, and inputting the programmed file to a controller of the electronic jacquard loom so as to weave the camouflage fabric 10.

FIG. 1 is a view illustrating simulation of a camouflage fabric 10 woven in accordance with one embodiment of the present invention. The patterns 20 having various shapes include A-colored patterns A, B-colored patterns B, C-colored patterns C, D-colored patterns D and E-colored patterns E, which express five colors, and colors of the respective patterns 20 are determined by colors and structures of warps and wefts.

Conditions of the warps and the wefts to acquire the camouflage fabric 10 shown in FIG. 1 are as follows.

Dyed yarns of two colors are alternately arranged and prepared as the warps necessary to weave the camouflage fabric 10. Here, warps of colors having a large brightness difference may be used.

In the present invention, warps of dark navy having low brightness are used as first warps WP1, and warps of beige having high brightness are used as second warps WP2.

As the wefts, dyed yarns of three colors differing from the colors of the warps are repeatedly arranged. Here, wefts of navy are used as first wefts WT1, wefts of brown are used as second wefts WT2, and wefts of khaki are used as third wefts WT3.

In the present invention, blended yarns of T/C34s having a blending ratio of 65:35 of polyester to cotton are used as the first and second warps WP1 and WP2, and blended yarns of T/C45s/2 having a blending ratio of 65:35 of polyester to cotton are used as the first, second and third wefts WT1, WT2 and WT3.

The above-described kinds, blending ratios and sizes of the warps and the wefts are exemplarily described as the conditions used in one embodiment of the present invention, and the warps and the wefts are not limited thereto. That is, the conditions of the warps and the wefts may be changed.

Hereinafter, methods of weaving the respective colored patterns will be described.

First, a method of weaving the A-colored pattern A will be described.

Figure 2:
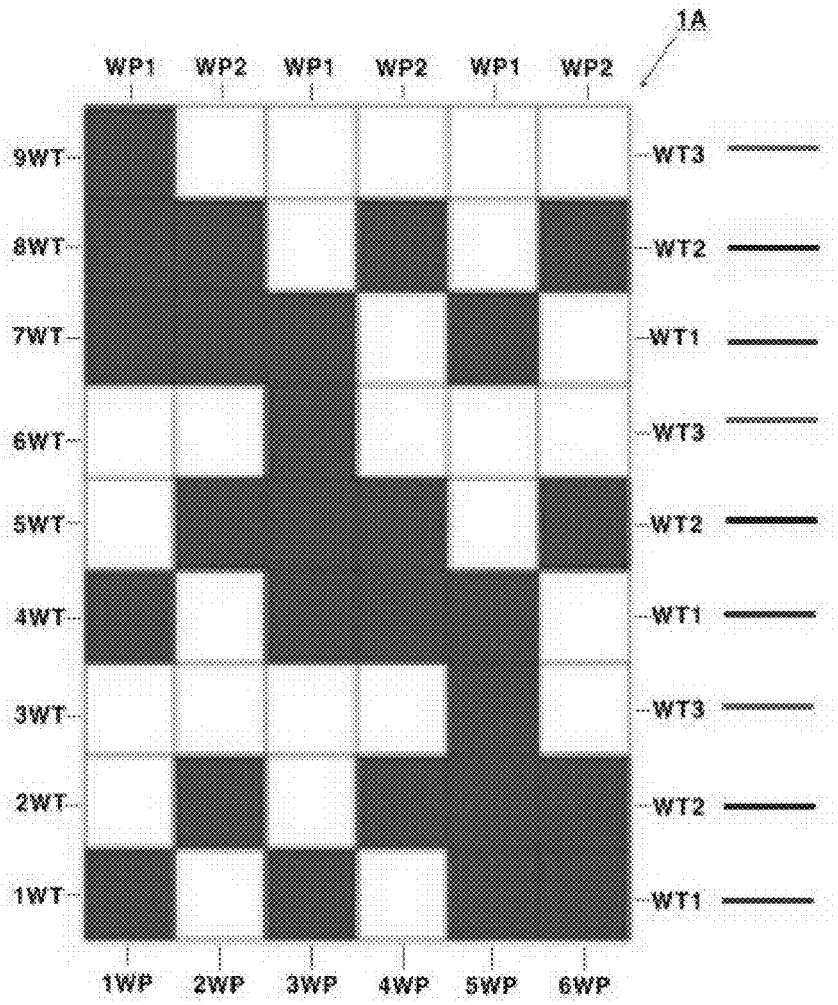
FIG. 2 is a view illustrating a design of a one-repeat weave of an A-colored pattern of FIG. 1.
Figure 3:
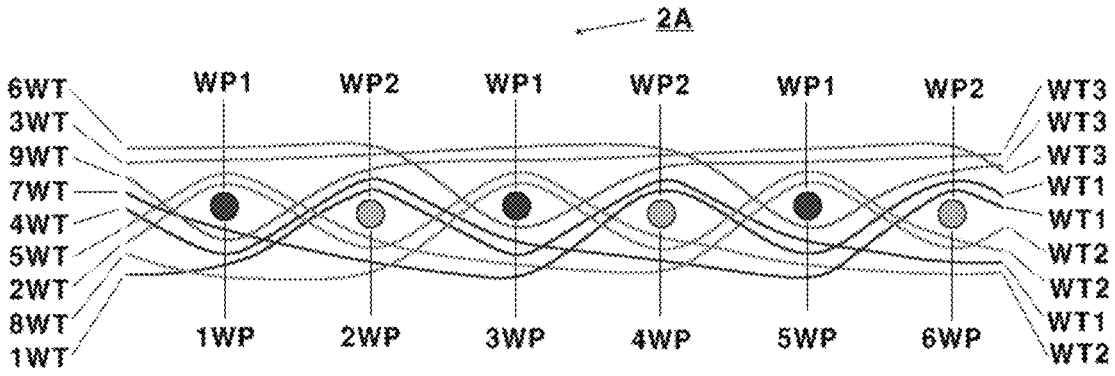
FIG. 3 is a view illustrating a structural textile design of warps and wefts of FIG. 2.

FIG. 2 is a view illustrating a design 1A of a one-repeat weave of the A-colored pattern A of FIG. 1, and FIG. 3 is a view illustrating a structural textile design 2A of warps and wefts of the one-repeat weave of the A-colored pattern A. The one-repeat weave of the A-colored pattern A includes three strands of each of the first and second warps WP1 and WP2 and three strands of each of the first, second and third wefts WT1, WT2 and WT3, i.e., a total of six strands of the warps and nine strands of the wefts.

That is, when the weft 1 1WT is inserted, the warp 1 1WP, the warp 3 3WP and the warp 5 5WP, which correspond to the first warps WP1 of dark navy, and the warp 6 6WP, which corresponds to the second warp WP2 of beige, are raised, and the warp 2 2WP and the warp 4 4WP, which corresponds to the second warps WP2 of beige, are lowered by heald motion of the jacquard loom so that the warps are shed and, in this state, the weft 1 1WT, which corresponds to the first weft WT1 of navy, is inserted into a shedding portion of the warps.

When the weft 2 2WT is inserted, the warp 2 2WP, the warp 4 4WP and the warp 6 6WP of beige, and the warp 5 5WP of dark navy are raised, and the warp 1 1WP and the warp 3 3WP of dark navy are lowered so that the warps are shed and, in this state, the weft 2 2WT, which corresponds to the second weft WT2 of brown, is inserted into a shedding portion of the warps.

When the weft 3 3WT is inserted, the warp 5 5WP of dark navy is raised, and the warps 1 to 4 1WP to 4WP and the warp 6 6WP are lowered so that the warps are shed and, in this case, the weft 3 3WT, which corresponds to the third weft WT3 of khaki, is inserted into a shedding portion of the warps.

When the weft 4 4WT is inserted, the warp 1 1WP, the warp 3 3WP and the warp 5 5WP of dark navy and the warp 4 4WP of beige are raised and the warp 2 2WP and the warp 6 6WP of beige are lowered so that the warps are shed and, in this state, the weft 4 4WT, which corresponds to the first weft WT1 of navy, is inserted into a shedding portion of the warps.

When the weft 5 5WT is inserted, the warp 2 2WP, the warp 4 4WP and the warp 6 6WP of beige and the warp 3 3WP of dark navy are raised and the warp 1 1WP and the warp 5 5WP of dark navy are lowered so that the warps are shed and, in this state, the weft 5 5WT, which corresponds to the second weft WT2 of brown, is inserted into a shedding portion of the warps.

When the weft 6 6WT is inserted, the warp 3 3WP of dark navy is raised and the warp 1 1WP and the warp 5 5WP of dark navy and the warp 2 2WP, the warp 4 4WP and the warp 6 6WP of beige are lowered and, in this case, the weft 6 6WT, which corresponds to the third weft WT3 of khaki, is inserted into a shedding portion of the warps.

When the weft 7 7WT is inserted, the warp 1 1WP, the warp 3 3WP and the warp 5 5WP of dark navy and the warp 2 2WP of beige are raised and the warp 4 4WP and the warp 6 6WP of beige are lowered so that the warps are shed and, in this state, the weft 7 7WT, which corresponds to the first weft WT1 of navy, is inserted into a shedding portion of the warps.

When the weft 8 8WT is inserted, the warp 1 1WP of dark navy and the warp 2 2WP, the warp 4 4WP and the warp 6 6WP of beige are raised and the warp 3 3WP and the warp 5 5WP of dark navy are lowered so that the warps are shed and, in this state, the weft 8 8WT, which corresponds to the second weft WT2 of brown, is inserted into a shedding portion of the warps.

When the weft 9 9WT is inserted, the warp 1 1WP of dark navy is raised and the warp 3 3WP and the warp 5 5WP of dark navy and the warp 2 2WP, the warp 4 4WP and the warp 6 6WP of beige are lowered so that the warps are shed and, in this case, the weft 9 9WT, which corresponds to the third weft WT3 of khaki, is inserted into a shedding portion of the warps.

As described above, the A-colored pattern A is woven by repeatedly arranging the warp 1 1WP to the warp 6 6WP and the weft 1 1WT to the weft 9 9WT, as exemplarily shown in FIG. 2.

Here, in the case of the A-colored pattern A, a ratio of the warps to the wefts, exposed from the surface of the camouflage fabric 10, is 27:27 based on the one-repeat weave. Here, a ratio of the first warps WP1 of dark navy to the second warps WP2 of beige, exposed from the surface of the camouflage fabric 10, is 15:12, i.e., the exposure rate of the first warps WP1 of dark navy is high, and a ratio of the first wefts WT1 of navy to the second wefts WT2 of brown to the third wefts WT3 of khaki, exposed from the surface of the camouflage fabric 10, is 6:6:15, thereby expressing the A-colored pattern A of FIG. 1 in overall dark khaki.

Next, a method of weaving the B-colored pattern B will be described.

Figure 4:
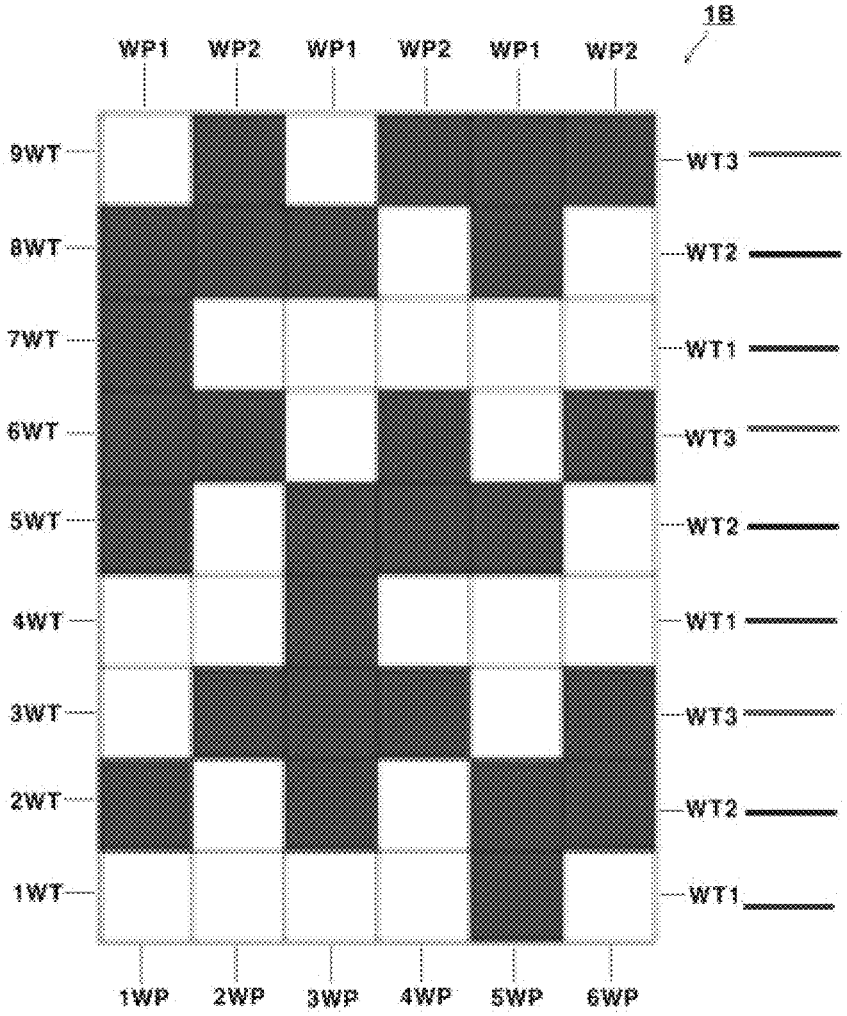
FIG. 4 is a view illustrating a design of a one-repeat weave of a B-colored pattern of FIG. 1.
Figure 5:
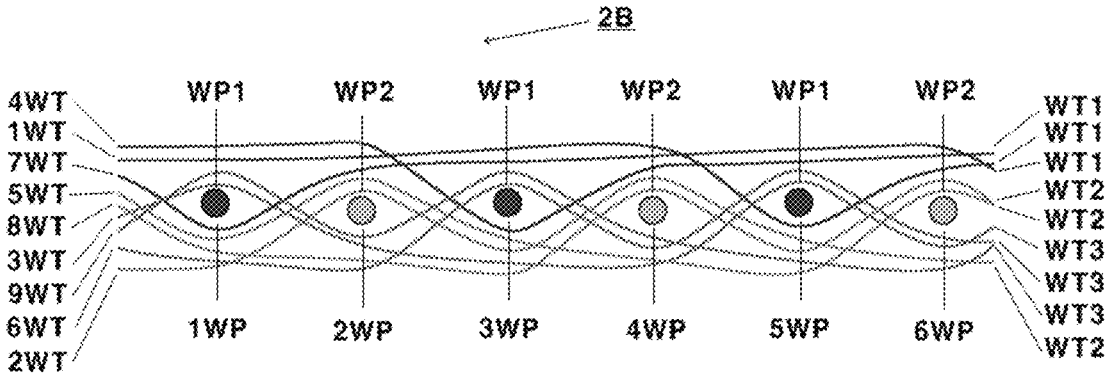
FIG. 5 is a view illustrating a structural textile design of warps and wefts of FIG. 4.

FIG. 4 is a view illustrating a design 1B of a one-repeat weave of the B-colored pattern B of FIG. 1, and FIG. 5 is a view illustrating a structural textile design 2B of warps and wefts of the one-repeat weave of the B-colored pattern B. The one-repeat weave of the B-colored pattern B includes three strands of each of the first and second warps WP1 and WP2 and three strands of each of the first, second and third wefts WT1, WT2 and WT3, i.e., a total of six strands of the warps and nine strands of the wefts.

That is, when the weft 1 1WT is inserted, the warp 5 5WP of dark navy is raised and the warps 1 to 4 1WP to 4WP and the warp 6 6WP are lowered by heald motion of the jacquard loom so that the warps are shed and, in this state, the weft 1 1WT of navy is inserted into a shedding portion of the warps.

When the weft 2 2WT is inserted, the warp 1 1WP, the warp 3 3WP and the warp 5 5WP of dark navy and the warp 6 6WP of beige are raised and the warp 2 2WP and the warp 4 4WP of beige are lowered so that the warps are shed and, in this state, the weft 2 2WT of brown is inserted into a shedding portion of the warps.

When the weft 3 3WT is inserted, the warp 3 3WP of dark navy and the warp 2 2WP, the warp 4 4WP and the warp 6

6WP of beige are raised and the warp 1 1WP and the warp 5 5WP of dark navy are lowered so that the warps are shed and, in this state, the weft 3 3WT of khaki is inserted into a shedding portion of the warps.

When the weft 4 4WT is inserted, the warp 3 3WP of dark navy is raised and the warp 1 1WP and the warp 5 5WP of dark navy and the warp 2 2WP, the warp 4 4WP and the warp 6 6WP of beige are lowered so that the warps are shed and, in this state, the weft 4 4WT of navy is inserted into a shedding portion of the warps.

When the weft 5 5WT is inserted, the warp 1 1WP, the warp 3 3WP and the warp 5 5WP of dark navy and the warp 4 4WP of beige are raised and the warp 2 2WP and the warp 6 6WP of beige are lowered so that the warps are shed and, in this state, the weft 5 5WT of brown is inserted into a shedding portion of the warps.

When the weft 6 6WT is inserted, the warp 1 1WP of dark navy and the warp 2 2WP, the warp 4 4WP and the warp 6 6WP of beige are raised and the warp 3 3WP and the warp 5 5WP of dark navy are lowered so that the warps are shed and, in this state, the weft 6 6WT of khaki is inserted into a shedding portion of the warps.

When the weft 7 7WT is inserted, the warp 1 1WP of dark navy is raised and the warp 3 3WP and the warp 5 5WP of dark navy and the warp 2 2WP, the warp 4 4WP and the warp 6 6WP of beige are lowered so that the warps are shed and, in this state, the weft 7 7WT of navy is inserted into a shedding portion of the warps.

When the weft 8 8WT is inserted, the warp 1 1WP, the warp 3 3WP and the warp 5 5WP of dark navy and the warp 2 2WP of beige are raised and the warp 4 4WP and the warp 6 6WP of beige are lowered so that the warps are shed and, in this state, the weft 8 8WT of brown is inserted into a shedding portion of the warps.

When the weft 9 9WT is inserted, the warp 5 5WP of dark navy and the warp 2 2WP, the warp 4 4WP and the warp 6 6WP of beige are raised and the warp 1 1WP and the warp 3 3WP of dark navy are lowered so that the warps are shed and, in this state, the weft 9 9WT of khaki is inserted into a shedding portion of the warps.

As described above, the B-colored pattern B is woven by repeatedly arranging the warp 1 1WP to the warp 6 6WP and the weft 1 1WT to the weft 9 9WT, as exemplarily shown in FIG. 4.

Here, in the case of the B-colored pattern B, a ratio of the warps to the wefts, exposed from the surface of the camouflage fabric 10, is 27:27 based on the one-repeat weave. Here, a ratio of the first warps WP1 of dark navy to the second warps WP2 of beige, exposed from the surface of the camouflage fabric 10, is 15:12, i.e., the exposure rate of the first warps WP1 of dark navy is high, and a ratio of the first wefts WT1 of navy to the second wefts WT2 of brown to the third wefts WT3 of khaki, exposed from the surface of the camouflage fabric 10, is 15:6:6, thereby expressing the B-colored pattern B of FIG. 1 in overall dark navy.

Next, a method of weaving the C-colored pattern C will be described.

Figure 6:
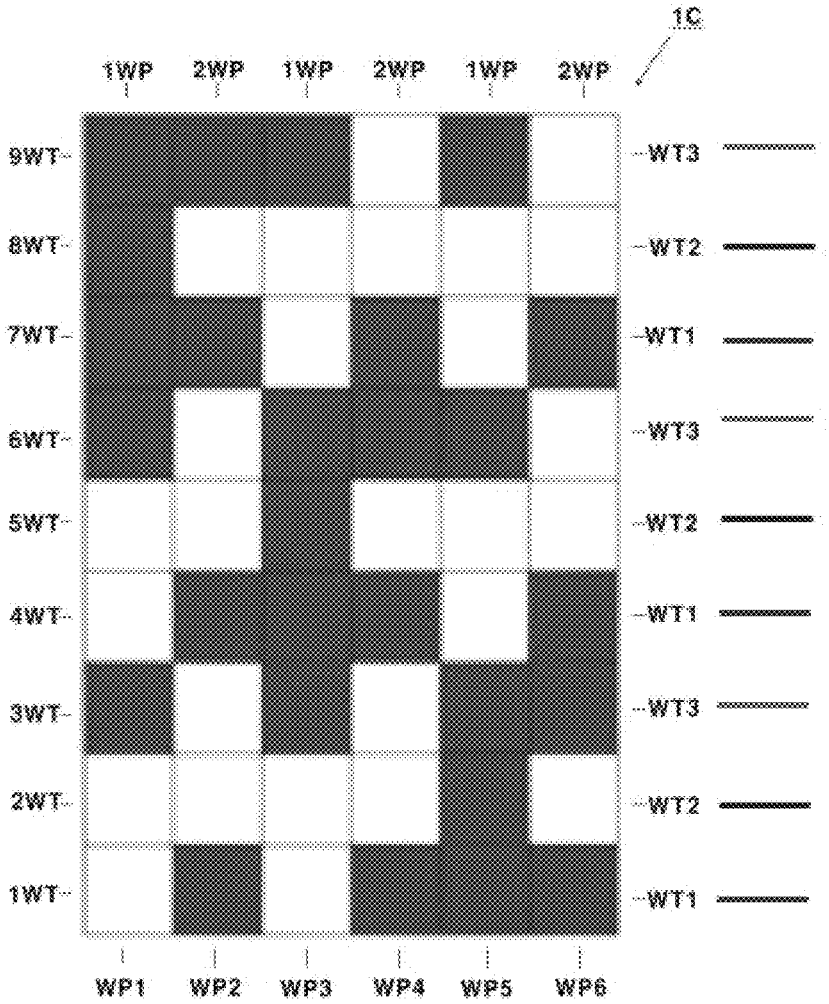
FIG. 6 is a view illustrating a design of a one-repeat weave of a C-colored pattern of FIG. 1.
Figure 7:
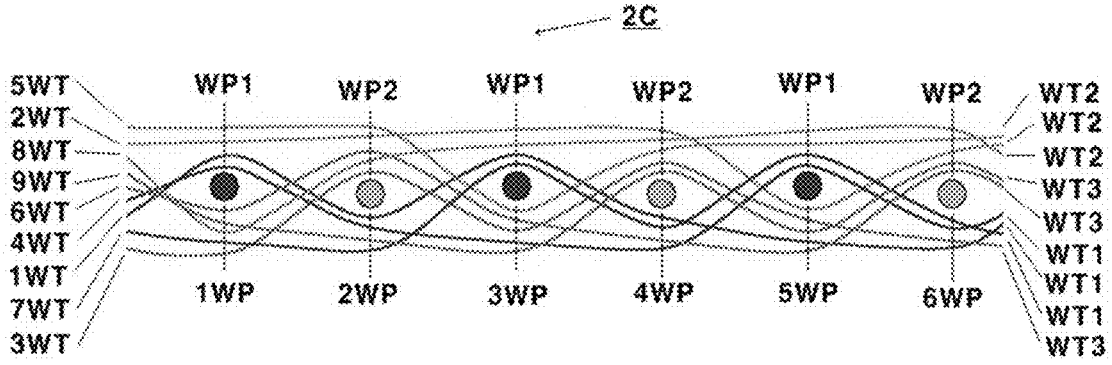
FIG. 7 is a view illustrating a structural textile design of warps and wefts of FIG. 6.

FIG. 6 is a view illustrating a design 1C of a one-repeat weave of the C-colored pattern C of FIG. 1, and FIG. 7 is a view illustrating a structural textile design 2C of warps and wefts of the one-repeat weave of the C-colored pattern C. The one-repeat weave of the C-colored pattern C includes three strands of each of the first and second warps WP1 and WP2 and three strands of each of the first, second and third wefts WT1, WT2 and WT3, i.e., a total of six strands of the warps and nine strands of the wefts.

That is, when the weft 1 1WT is inserted, the warp 5 5WP of dark navy and the warp 2 2WP, the warp 4 4WP and the warp 6 6WP of beige are raised and the warp 1 1WP and the warp 3 3WP of dark navy are lowered by heald motion of the jacquard loom so that the warps are shed and, in this state, the weft 1 1WT of navy is inserted into a shedding portion of the warps.

When the weft 2 2WT is inserted, the warp 5 5WP of dark navy is raised and the warps 1 to 4 1WP to 4WP and the warp 6 6WP are lowered so that the warps are shed and, in this state, the weft 2 2WT of brown is inserted into a shedding portion of the warps.

When the weft 3 3WT is inserted, the warp 1 1WP, the warp 3 3WP and the warp 5 5WP of dark navy and the warp 6 6WP of beige are raised and the warp 2 2WP and the warp 4 4WP of beige are lowered so that the warps are shed and, in this state, the weft 3 3WT of khaki is inserted into a shedding portion of the warps.

When the weft 4 4WT is inserted, the warp 3 3WP of dark navy and the warp 2 2WP, the warp 4 4WP and the warp 6 6WP of beige are raised and the warp 1 1WP and the warp 5 5WP of dark navy are lowered so that the warps are shed and, in this state, the weft 4 4WT of navy is inserted into a shedding portion of the warps.

When the weft 5 5WT is inserted, the warp 3 3WP of dark navy is raised and the warp 1 1WP, the warp 2 2WP, the warp 4 4WP, the warp 5 5WP and the warp 6 6WP are lowered so that the warps are shed and, in this state, the weft 5 5WT of brown is inserted into a shedding portion of the warps.

When the weft 6 6WT is inserted, the warp 1 1WP, the warp 3 3WP and the warp 5 5WP of dark navy and the warp 4 4WP of beige are raised and the warp 2 2WP and the warp 6 6WP of beige are lowered so that the warps are shed and, in this state, the weft 6 6WT of khaki is inserted into a shedding portion of the warps.

When the weft 7 7WT is inserted, the warp 1 1WP of dark navy and the warp 2 2WP, the warp 4 4WP and the warp 6 6WP of beige are raised and the warp 3 3WP and the warp 5 5WP of dark navy are lowered so that the warps are shed and, in this state, the weft 7 7WT of navy is inserted into a shedding portion of the warps.

When the weft 8 8WT is inserted, the warp 1 1WP of dark navy is raised and the warp 2 2WP to the warp 6 6WP are lowered so that the warps are shed and, in this state, the weft 8 8WT of brown is inserted into a shedding portion of the warps.

When the weft 9 9WT is inserted, the warp 1 1WP, the warp 3 3WP and the warp 5 5WP of dark navy and the warp 2 2WP of beige are raised and the warp 4 4WP and the warp 6 6WP of beige are lowered so that the warps are shed and, in this state, the weft 9 9WT of khaki is inserted into a shedding portion of the warps.

As described above, the C-colored pattern C is woven by repeatedly arranging the warp 1 1WP to the warp 6 6WP and the weft 1 1WT to the weft 9 9WT, as exemplarily shown in FIG. 6.

Here, in the case of the C-colored pattern C, a ratio of the warps to the wefts, exposed from the surface of the camouflage fabric 10, is 27:27 based on the one-repeat weave. Here, a ratio of the first warps WP1 of dark navy to the second warps WP2 of beige, exposed from the surface of the camouflage fabric 10, is 15:12, i.e., the exposure rate of the first warps WP1 of dark navy is high, and a ratio of the first wefts WT1 of navy to the second wefts WT2 of brown to the third wefts WT3 of khaki, exposed from the surface of the camouflage fabric 10, is 6:15:6, thereby expressing the C-colored pattern C of FIG. 1 in overall dark brown.

Next, a method of weaving the D-colored pattern D will be described.

Figure 8:
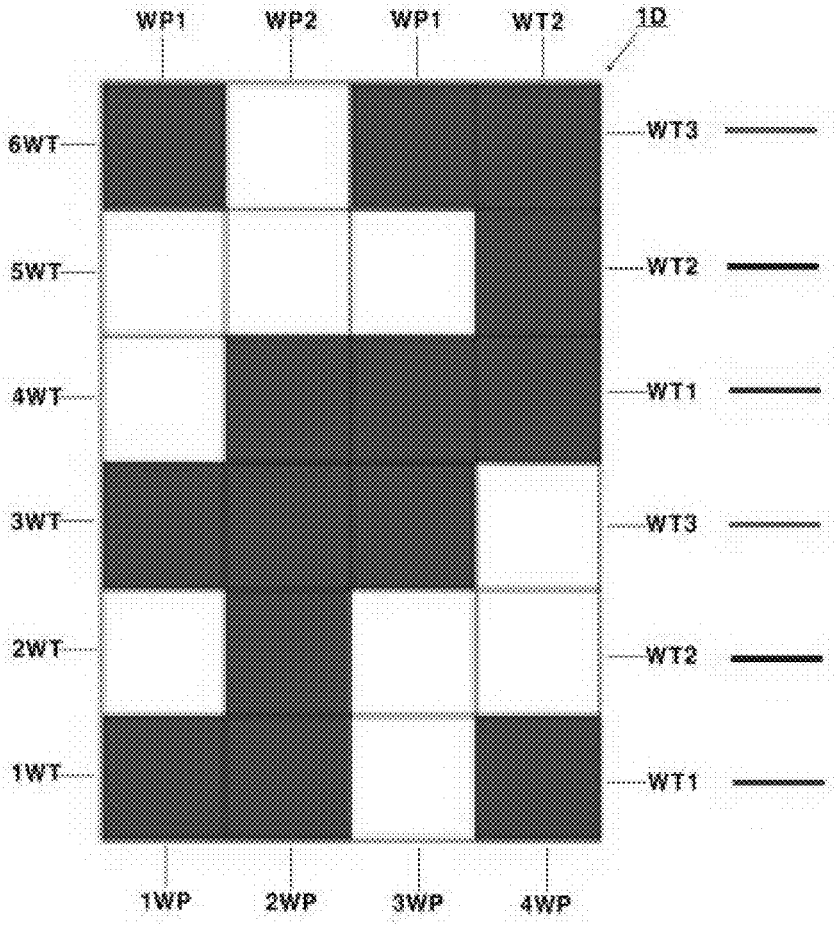
FIG. 8 is a view illustrating a design of a one-repeat weave of a D-colored pattern of FIG. 1.
Figure 9:
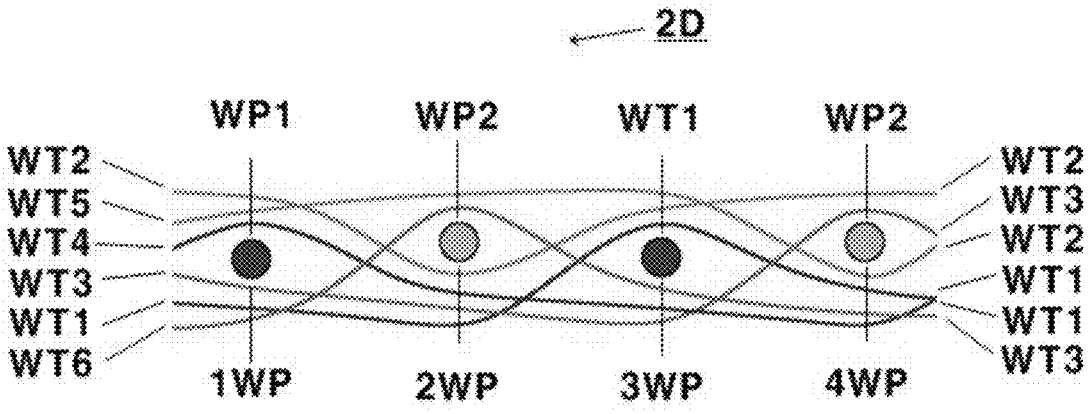
FIG. 9 is a view illustrating a structural textile design of warps and wefts of FIG. 8.

FIG. 8 is a view illustrating a design 1D of a one-repeat weave of the D-colored pattern D of FIG. 1, and FIG. 9 is a view illustrating a structural textile design 2D of warps and wefts of the one-repeat weave of the D-colored pattern D. The one-repeat weave of the D-colored pattern D includes two strands of each of the first and second warps WP1 and WP2 and two strands of each of the first, second and third wefts WT1, WT2 and WT3, i.e., a total of four strands of the warps and six strands of the wefts.

That is, when the weft 1 1WT is inserted, the warp 1 1WP of dark navy and the warp 2 2WP and the warp 4 4WP of beige are raised and the warp 3 3WP of dark navy is lowered by heald motion of the jacquard loom so that the warps are shed and, in this state, the weft 1 1WT of navy is inserted into a shedding portion of the warps.

When the weft 2 2WT is inserted, the warp 2 2WP of beige is raised and the warp 1 1WP and the warp 3 3WP of dark navy and the warp 4 4WP of beige are lowered so that the warps are shed and, in this state, the weft 2 2WT of brown is inserted into a shedding portion of the warps.

When the weft 3 3WT is inserted, the warp 1 1WP and the warp 3 3WP of dark navy and the warp 2 2WP of beige are raised and the warp 4 4WP of beige is lowered so that the warps are shed and, in this state, the weft 3 3WT of khaki is inserted into a shedding portion of the warps.

When the weft 4 4WT is inserted, the warp 3 3WP of dark navy and the warp 2 2WP and the warp 4 4WP of beige are raised and the warp 1 1WP of dark navy is lowered so that the warps are shed and, in this state, the weft 4 4WT of navy is inserted into a shedding portion of the warps.

When the weft 5 5WT is inserted, the warp 4 4WP of beige is raised and the warp 1 1WP and the warp 3 3WP of dark navy and the warp 2 2WP of beige are lowered so that the warps are shed and, in this state, the weft 5 5WT of brown is inserted into a shedding portion of the warps.

When the weft 6 6WT is inserted, the warp 1 1WP and the warp 3 3WP of dark navy and the warp 4 4WP of beige are raised and the warp 2 2WP of beige is lowered so that the warps are shed and, in this state, the weft 6 6WT of khaki is inserted into a shedding portion of the warps.

As described above, the D-colored pattern D is woven by repeatedly arranging the warp 1 1WP to the warp 4 4WP and the weft 1 1WT to the weft 6 6WT, as exemplarily shown in FIG. 8.

Here, in the case of the D-colored pattern D, a ratio of the warps to the wefts, exposed from the surface of the camouflage fabric 10, is 14:10 based on the one-repeat weave, i.e., the exposure rate of the warps is high. Here, a ratio of the first warps WP1 of dark navy to the second warps WP2 of beige, exposed from the surface of the camouflage fabric 10, is 6:8, i.e., the exposure rate of the second warps WP2 of beige is high, and a ratio of the first wefts WT1 of navy to the second wefts WT2 of brown to the third wefts WT3 of khaki, exposed from the surface of the camouflage fabric 10, is 2:6:2, i.e., the exposure rate of the second wefts WT2 of brown is high, thereby expressing the D-colored pattern D of FIG. 1 in overall light brown.

Next, a method of weaving the E-colored pattern E will be described.

Figure 10:
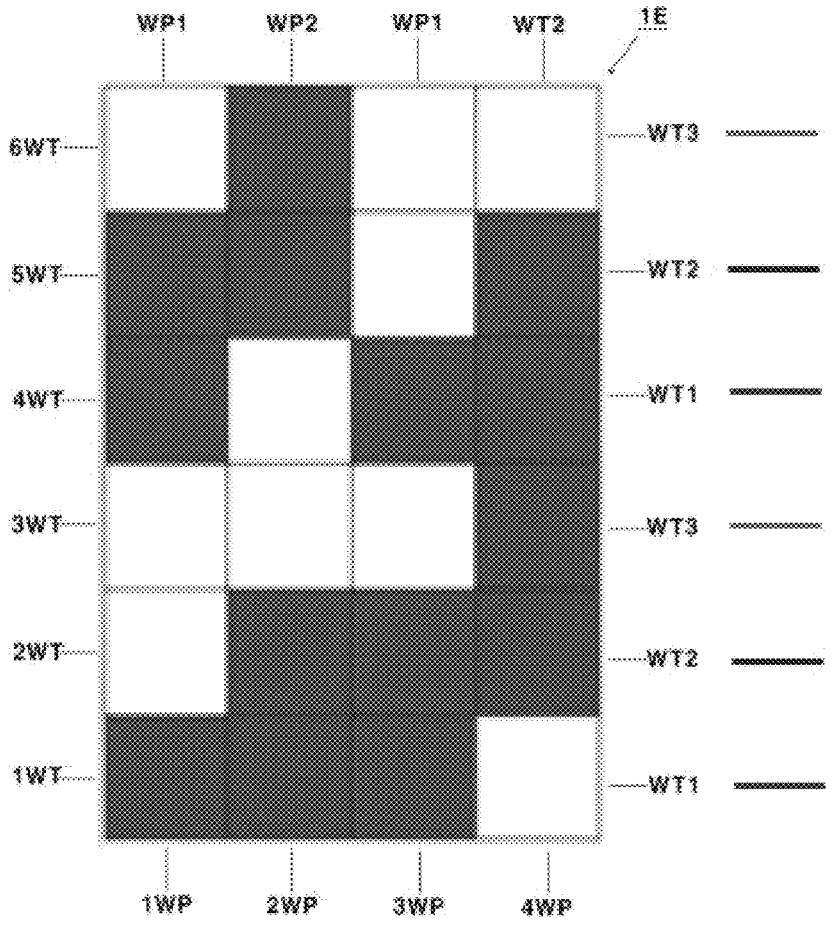
FIG. 10 is a view illustrating a design of a one-repeat weave of an E-colored pattern of FIG. 1.
Figure 11:
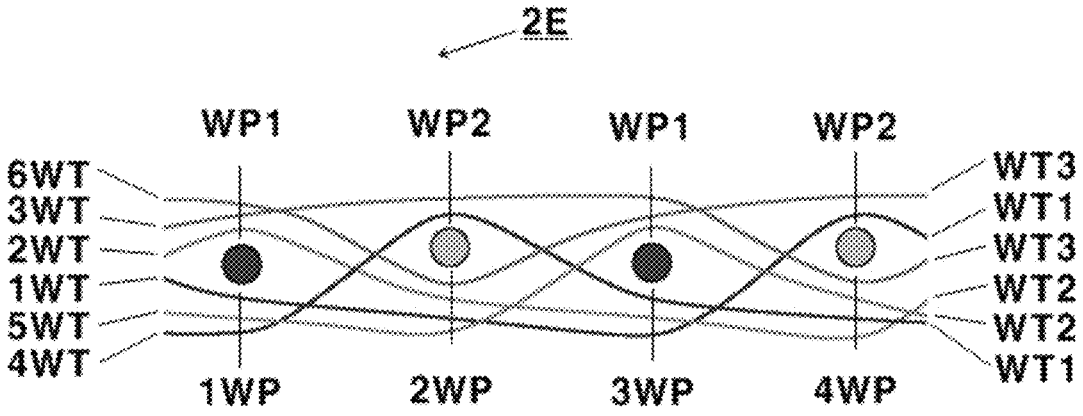
FIG. 11 is a view illustrating a structural textile design of warps and wefts of FIG. 10.

FIG. 10 is a view illustrating a design 1E of a one-repeat weave of the E-colored pattern E of FIG. 1, and FIG. 11 is a view illustrating a structural textile design 2E of warps and wefts of the one-repeat weave of the E-colored pattern E. The one-repeat weave of the E-colored pattern E includes two strands of each of the first and second warps WP1 and WP2 and two strands of each of the first, second and third wefts WT1, WT2 and WT3, i.e., a total of four strands of the warps and six strands of the wefts.

That is, when the weft 1 1WT is inserted, the warp 1 1WP and the warp 3 3WP of dark navy and the warp 2 2WP of beige are raised and the warp 4 4WP of beige is lowered by heald motion of the jacquard loom so that the warps are shed and, in this state, the weft 1 1WT of navy is inserted into a shedding portion of the warps.

When the weft 2 2WT is inserted, the warp 3 3WP of dark navy and the warp 2 2WP and the warp 4 4WP of beige are raised and the warp 1 1WP of dark navy is lowered so that the warps are shed and, in this state, the weft 2 2WT of brown is inserted into a shedding portion of the warps.

When the weft 3 3WT is inserted, the warp 4 4WP of beige is raised and the warp 1 1WP and the warp 3 3WP of dark navy and the warp 2 2WP of beige are lowered so that the warps are shed and, in this state, the weft 3 3WT of khaki is inserted into a shedding portion of the warps.

When the weft 4 4WT is inserted, the warp 1 1WP and the warp 3 3WP of dark navy and the warp 4 4WP of beige are raised and the warp 2 2WP of beige is lowered so that the warps are shed and, in this state, the weft 4 4WT of navy is inserted into a shedding portion of the warps.

When the weft 5 5WT is inserted, the warp 1 1WP of dark navy and the warp 2 2WP and the warp 4 4WP of beige are raised and the warp 3 3WP of dark navy is lowered so that the warps are shed and, in this state, the weft 5 5WT of brown is inserted into a shedding portion of the warps.

When the weft 6 6WT is inserted, the warp 2 2WP of beige is raised and the warp 1 1WP and the warp 3 3WP of dark navy and the warp 4 4WP of beige are lowered so that the warps are shed and, in this state, the weft 6 6WT of khaki is inserted into a shedding portion of the warps.

As described above, the E-colored pattern E is woven by repeatedly arranging the warp 1 1WP to the warp 4 4WP and the weft 1 1WT to the weft 6 6WT, as exemplarily shown in FIG. 10.

Here, in the case of the E-colored pattern E, a ratio of the warps to the wefts, exposed from the surface of the camouflage fabric 10, is 14:10 based on the one-repeat weave, i.e., the exposure rate of the warps is high. Here, a ratio of the first warps WP1 of dark navy to the second warps WP2 of beige, exposed from the surface of the camouflage fabric 10, is 6:8, i.e., the exposure rate of the second warps WP2 of beige is high, and a ratio of the first wefts WT1 of navy to the second wefts WT2 of brown to the third wefts WT3 of khaki, exposed from the surface of the camouflage fabric 10, is 2:2:6, i.e., the exposure rate of the third wefts WT3 of khaki is high, thereby expressing the E-colored pattern E of FIG. 1 in overall light khaki.

In the above-described embodiment, in order to satisfy the shapes and colors of the patterns 20 of the camouflage fabric 10 shown in FIG. 11, yarns of two colors having brightnesses which are clearly distinguishable from each other, i.e., having a large brightness difference, such as dark navy and beige, are repeatedly arranged as warps, and yarns of three colors differing from the colors of the warps, i.e., navy, brown and khaki, are repeatedly arranged as wefts, thus weaving the camouflage fabric 10 using the jacquard loom. Here, by varying one-repeat weave manufactured by interlacing the warps and the wefts, the A-colored pattern A, the B-colored pattern B, the C-colored pattern C, the D-colored pattern D and the E-colored pattern E are expressed.

Even in the above-described embodiment, if a structural textile design of the warps and the wefts is varied under the same conditions of the warps and the wefts, a camouflage fabric having patterns and colors differing from those of the camouflage fabric 10 of FIG. 1 may be woven.

Therefore, in the present invention, patterns of various colors may be acquired by varying one-repeat weave of each colored pattern while repeatedly arranging warps of two colors having a large brightness difference and repeatedly arranging wefts of three colors differing from the colors of the warps, thus providing an optimum camouflage fabric suitable for geography.

Particularly, the present invention may provide a high-quality camouflage fabric of a jacquard texture woven using a jacquard loom, which has an excellent camouflaging effect and improves functions as clothing, i.e., tactility and aesthetics, which conventional camouflage fabrics may not provide, while satisfying an aesthetic sense of camouflage fabrics of a spotted pattern or a digital pattern, widely used now in various countries in the world, using characteristics of the jacquard fabric.

In implementation of the present invention, if warps of two or more colors are selected and wefts of three or more colors are selected, a wider variety of colors of patterns may be expressed.

Further, although the present invention exemplarily describes blended yarns of T/C34s (65:35) as the warps and blended yarns of T/C45s/2 (65:35) as the wefts, if thin yarns are used as the warps and wefts, a thin camouflage fabric may be woven so as to be usefully worn in hot climates or in summer.

As is apparent from the above description, the present invention provides a camouflage fabric of a three-ply jacquard texture woven using a jacquard loom, in which dyed yarns of a dark color and dyed yarns of a light color are alternately arranged as warps and dyed yarns of three colors differing from the colors of the warps are used as wefts so as to simplify a preparation process of the warps and the wefts and thus to assure convenience in warp and weft preparation, and, particularly, combinations of various patterns and colors are acquired using three-ply texture so as to satisfy aesthetics, i.e., one of functions of clothing, and to have an excellent camouflaging effect.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of weaving a camouflage fabric of a three-ply jacquard texture using a jacquard loom, comprising determining shapes and colors of patterns of the camouflage fabric desired to be woven, determining colors of warps and wefts expressing the colors of the patterns, making a weaving design and a structural textile design to express the shapes and the colors of the patterns using the warps and the wefts, programming the designs into a file, and inputting the programmed file to a controller of the jacquard loom, wherein first and second warps of different colors having a large brightness difference are repeatedly arranged as the warps and first, second and third wefts of different colors, differing from the colors of the warps, are repeatedly arranged as the wefts, and are thus woven into the three-ply jacquard texture so as to express the patterns of different colors.

2. The method according to claim 1, wherein dyed yarns are used as the first and second warps and the first, second the third wefts, wherein the first warps of dark navy, the second warps of beige, the first wefts of navy, the second wefts of brown and the third wefts of khaki are woven into A-colored patterns, B-colored patterns, C-colored patterns, D-colored patterns and E-colored patterns.

3. The method according to claim 1, wherein the first warps of dark navy and the second warps of beige are repeatedly arranged and the first wefts of navy, the second wefts of brown and the third wefts of khaki are repeatedly arranged so as to be woven into A-colored patterns, B-colored patterns, C-colored patterns, D-colored patterns and E-colored patterns, wherein:

a one-repeat weave of the A-colored pattern includes a total of six strands of the warps and nine strands of the wefts, including three strands of each of the first and second warps and three strands of each of the first, second and third wefts, and is woven by raising the warp 1, the warp 3 and the warp 5, corresponding to the first warps of dark navy and the warp 6, corresponding to the second warp of beige, and lowering the warp 2 and the warp 4, corresponding to the second warps of beige, by heald motion of the jacquard loom so that the warps are shed and then by inserting the weft 1, corresponding to the first weft of navy, into a shedding portion of the warps, by raising the warp 2, the warp 4 and the warp 6 of beige and the warp 5 of dark navy and lowering the warp 1 and the warp 3 of dark navy so that the warps are shed and then by inserting the weft 2, corresponding to the second weft of brown, into a shedding portion of the warps, by raising the warp 5 of dark navy and lowering the warps 1 to 4 and the warp 6 so that the warps are shed and then by inserting the weft 3, corresponding to the third weft of khaki, into a shedding portion of the warps, by raising the warp 1, the warp 3 and the warp 5 of dark navy and the warp 4 of beige and lowering the warp 2 and the warp 6 of beige so that the warps are shed and then by inserting the weft 4, corresponding to the first weft of navy, into a shedding portion of the warps, by raising the warp 2, the warp 4 and the warp 6 of beige and the warp 3 of dark navy and lowering the warp 1 and the warp 5 of dark navy so that the warps are shed and then by inserting the weft 5, corresponding to the second weft of brown, into a shedding portion of the warps, by raising the warp 3 of dark navy and lowering the warp 1 and the warp 5 of dark navy and the warp 2, the warp 4 and the warp 6 of beige and then by inserting the weft 6, corresponding to the third weft of khaki, into a shedding portion of the warps, by raising the warp 1, the warp 3 and the warp 5 of dark navy and the warp 2 of beige and lowering the warp 4 and the warp 6 of beige so that the warps are shed and then by inserting the weft 7, corresponding to the first weft of navy, into a shedding portion of the warps, by raising the warp 1 of dark navy and the warp 2, the warp 4 and the warp 6 of beige and lowering the warp 3 and the warp 5 of dark navy so that the warps are shed and then by inserting the weft 8, corresponding to the second weft of brown, into a shedding portion of the warps, and by raising the warp 1 of dark navy and the warp 3 and the warp 5 of dark navy and the warp 2, the warp 4 and the warp 6 of beige so that the warps are shed and then by inserting the weft 9, corresponding to the third weft of khaki, into a shedding portion of the warps;

a one-repeat weave of the B-colored pattern includes a total of six strands of the warps and nine strands of the wefts, including three strands of each of the first and second warps and three strands of each of the first, second and third wefts, and is woven by raising the warp 5 of dark navy and lowering the warp 1 and the warp 3 of dark navy and the warp 2, the warp 4 and the warp 6 of beige by heald motion of the jacquard loom so that the warps are shed and then by inserting the weft 1 of navy into a shedding portion of the warps, by raising the warp 1, the warp 3 and the warp 5 of dark navy and the warp 6 of beige and lowering the warp 2 and the warp 4 of beige so that the warps are shed and then by inserting the weft 2 of brown into a shedding portion of the warps, by raising the warp 3 of dark navy and the warp 2, the warp 4 and the warp 6 of beige and lowering the warp 1 and the warp 5 of dark navy so that the warps are shed and then by inserting the weft 3 of khaki into a shedding portion of the warps, by raising the warp 3 of dark navy and lowering the warp 1 and the warp 5 of dark navy and the warp 2, the warp 4 and the warp 6 of beige so that the warps are shed and then by inserting the weft 4 of navy into a shedding portion of the warps, by raising the warp 1, the warp 3 and the warp 5 of dark navy and the warp 4 of beige and lowering the warp 2 and the warp 6 of beige so that the warps are shed and then by inserting the weft 5 of brown into a shedding portion of the warps, by raising the warp 1 of dark navy and the warp 2, the warp 4 and the warp 6 of beige and lowering the warp 3 and the warp 5 of dark navy so that the warps are shed and then by inserting the weft 6 of khaki into a shedding portion of the warps, by raising the warp 1 of dark navy is raised and the warp 3 and the warp 5 of dark navy and the warp 2, the warp 4 and the warp 6 of beige are lowered so that the warps are shed and then by inserting the weft 7 of navy into a shedding portion of the warps, by raising the warp 1, the warp 3 and the warp 5 of dark navy and the warp 2 of beige and lowering the warp 4 and the warp 6 of beige so that the warps are shed and then by inserting the weft 8 of brown into a shedding portion of the warps, and by raising the warp 5 of dark navy and the warp 2, the warp 4 and the warp 6 of beige and lowering the warp 1 and the warp 3 of dark navy so that the warps are shed and then by inserting the weft 9 of khaki into a shedding portion of the warps;

a one-repeat weave of the C-colored pattern includes a total of six strands of the warps and nine strands of the wefts, including three strands of each of the first and second warps and three strands of each of the first, second and third wefts, and is woven by raising the warp 5 of dark navy and the warp 2, the warp 4 and the warp 6 of beige and lowering the warp 1 and the warp 3 of dark navy by heald motion of the jacquard loom so that the warps are shed and then by inserting the weft 1 of navy into a shedding portion of the warps, by raising the warp 5 of dark navy and lowering the warps 1 to 4 and the warp 6 so that the warps are shed and then by inserting the weft 2 of brown into a shedding portion of the warps, by raising the warp 1, the warp 3 and the warp 5 of dark navy and the warp 6 of beige and lowering the warp 2 and the warp 4 of beige so that the warps are shed and then by inserting the weft 3 of khaki into a shedding portion of the warps, by raising the warp 3 of dark navy and the warp 2, the warp 4 and the warp 6 of beige and lowering the warp 1 and the warp 5 of dark navy so that the warps are shed and then by inserting the weft 4 of navy into a shedding portion of the warps, by raising the warp 3 of dark navy and lowering the warp 1, the warp 2, the warp 4, the warp 5 and the warp 6 so that the warps are shed and then by inserting the weft 5 of brown into a shedding portion of the warps, by raising the warp 1, the warp 3 and the warp 5 of dark navy and the warp 4 of beige and lowering the warp 2 and the warp 6 of beige so that the warps are shed and then by inserting the weft 6 of khaki into a shedding portion of the warps, by raising the warp 1 of dark navy and the warp 2, the warp 4 and the warp 6 of beige and lowering the warp 3 and the warp 5 of dark navy so that the warps are shed and then by inserting the weft 7 of navy into a shedding portion of the warps, by raising the warp 1 of dark navy and lowering the warp 2 to the warp 6 so that the warps are shed and then by inserting the weft 8 of brown into a shedding portion of the warps, and by raising the warp 1, the warp 3 and the warp 5 of dark navy and the warp 2 of beige and lowering the warp 4 and the warp 6 of beige so that the warps are shed and then by inserting the weft 9 of khaki into a shedding portion of the warps;

a one-repeat weave of the D-colored pattern includes a total of four strands of the warps and six strands of the wefts, including two strands of each of the first and second warps and two strands of each of the first, second and third wefts, and is woven by raising the warp 1 of dark navy and the warp 2 and the warp 4 of beige and lowering the warp 3 of dark navy by heald motion of the jacquard loom so that the warps are shed and then by inserting the weft 1 of navy into a shedding portion of the warps, by raising the warp 2 of beige and lowering the warp 1 and the warp 3 of dark navy and the warp 4 of beige so that the warps are shed and then by inserting the weft of brown into a shedding portion of the warps, by raising the warp 1 and the warp 3 of dark navy and the warp 2 of beige and lowering the warp 4 so that the warps are shed and then by inserting the weft 3 of khaki into a shedding portion of the warps, by raising the warp 3 of dark navy and the warp 2 and the warp 4 of beige and lowering the warp 1 of dark navy so that the warps are shed and then by inserting the weft 4 of navy into a shedding portion of the warps, by raising the warp 4 of beige and lowering the warp 1 and the warp 3 of dark navy and the warp 2 of beige so that the warps are shed and then by inserting weft 5 of brown into a shedding portion of the warps, and by raising the warp 1 and the warp 3 of dark navy and the warp 4 of beige and lowering the warp 2 of beige so that the warps are shed and then by inserting the weft 6 of khaki into a shedding portion of the warps; and a one-repeat weave of the E-colored pattern includes a total of four strands of the warps and six strands of the wefts, including two strands of each of the first and second warps and two strands of each of the first, second and third wefts, and is woven by raising the warp 1 and the warp 3 of dark navy and the warp 2 of beige and lowering the warp 4 of beige by heald motion of the jacquard loom so that the warps are shed and then by inserting the weft 1 of navy into a shedding portion of the warps, by raising the warp 3 of dark navy and the warp 2 and the warp 4 of beige and lowering the warp 1 of dark navy so that the warps are shed and then by inserting the weft 2 of brown into a shedding portion of the warps, by raising the warp 4 of beige and lowering the warp 1 and the warp 3 of dark navy and the warp 2 of beige so that the warps are shed and then by inserting the weft 3 of khaki into a shedding portion of the warps, by raising the warp 1 and the warp 3 of dark navy and the warp 4 of beige and lowering the warp 2 of beige so that the warps are shed and then by inserting the weft 4 of navy into a shedding portion of the warps, by raising the warp 1 of dark navy and the warp 2 and the warp 4 of beige and lowering the warp 3 of dark navy so that the warps are shed and then by inserting the weft 5 of brown into a shedding portion of the warps, and by raising the warp 2 of beige and lowering the warp 1 and the warp 3 of dark navy and the warp 4 of beige so that the warps are shed and then by inserting the weft 6 of khaki into a shedding portion of the warps.

4. The method according to claim 3, wherein:

in the A-colored pattern, a ratio of the warps to the wefts, exposed from the surface of the camouflage fabric, is 27:27 based on the one-repeat weave, a ratio of the first warps of dark navy to the second warps of beige, exposed from the surface of the camouflage fabric, is 15:12 so as to have a high exposure rate of dark navy, and a ratio of the first wefts of navy to the second wefts of brown to the third wefts of khaki, exposed from the surface of the camouflage fabric, is 6:6:15;

in the B-colored pattern, a ratio of the warps to the wefts, exposed from the surface of the camouflage fabric, is 27:27 based on the one-repeat weave, a ratio of the first warps of dark navy to the second warps of beige, exposed from the surface of the camouflage fabric, is 15:12 so as to have a high exposure rate of dark navy, and a ratio of the first wefts of navy to the second wefts of brown to the third wefts of khaki, exposed from the surface of the camouflage fabric, is 15:6:6;

in the C-colored pattern, a ratio of the warps to the wefts, exposed from the surface of the camouflage fabric, is 27:27 based on the one-repeat weave, a ratio of the first warps of dark navy to the second warps of beige, exposed from the surface of the camouflage fabric, is 15:12 so as to have a high exposure rate of dark navy, and a ratio of the first wefts of navy to the second wefts of brown to the third wefts of khaki, exposed from the surface of the camouflage fabric, is 6:15:6;

in the D-colored pattern, a ratio of the warps to the wefts, exposed from the surface of the camouflage fabric, is 14:10 based on the one-repeat weave so as to have a high exposure rate of the warps, a ratio of the first warps of dark navy to the second warps of beige, exposed from the surface of the camouflage fabric, is 6:8 so as to have a high exposure rate of beige, and a ratio of the first wefts of navy to the second wefts of brown to the third wefts of khaki, exposed from the surface of the camouflage fabric 10, is 2:6:2 so as to have a high exposure rate of brown; and in the E-colored pattern E, a ratio of the warps to the wefts, exposed from the surface of the camouflage fabric, is 14:10 based on the one-repeat weave so as to have a high exposure rate of the warps, a ratio of the first warps of dark navy to the second warps of beige, exposed from the surface of the camouflage fabric, is 6:8 so as to have a high exposure rate of beige, and a ratio of the first wefts of navy to the second wefts of brown to the third wefts of khaki, exposed from the surface of the camouflage fabric, is 2:2:6 so as to have a high exposure rate of khaki.

* * * * *